US011560704B2

(12) United States Patent
Gee et al.

(10) Patent No.: US 11,560,704 B2
(45) Date of Patent: Jan. 24, 2023

(54) NOISE REDUCTION PIPES, VACUUM-ASSISTED TOILET SYSTEMS INCLUDING THE SAME, AND METHODS OF USING THE SAME

(71) Applicant: BRIGHAM YOUNG UNIVERSITY, Provo, UT (US)

(72) Inventors: Kent L. Gee, Provo, UT (US); Scott D. Sommerfeldt, Provo, UT (US); Scott L. Thomson, Provo, UT (US); Michael Rose, Provo, UT (US)

(73) Assignee: BRIGHAM YOUNG UNIVERSITY, Provo, UT (US)

( * ) Notice: Subject to any disclaimer, the term of this patent is extended or adjusted under 35 U.S.C. 154(b) by 0 days.

(21) Appl. No.: 16/968,259

(22) PCT Filed: Mar. 21, 2019

(86) PCT No.: PCT/US2019/023414

§ 371 (c)(1),
(2) Date: Aug. 7, 2020

(87) PCT Pub. No.: WO2020/190302

PCT Pub. Date: Sep. 24, 2020

(65) Prior Publication Data

US 2021/0404165 A1 Dec. 30, 2021

(51) Int. Cl.
*E03D 11/18* (2006.01)

(52) U.S. Cl.
CPC ..... *E03D 11/18* (2013.01); *E03D 2201/20* (2013.01)

(58) Field of Classification Search
CPC ..... E03D 11/18; E03D 11/02; E03D 2201/20; E03D 5/01; E03F 1/006
(Continued)

(56) References Cited

U.S. PATENT DOCUMENTS 434,116 A * 8/1890 Ricketts ..... F16L 43/001 4/417
2,075,030 A * 3/1937 Dunean, Jr. ..... E03D 11/13 4/422

(Continued)

FOREIGN PATENT DOCUMENTS

CN 1111704 A 11/1995
CN 1115961 A 1/1996

(Continued)

OTHER PUBLICATIONS

International Search Report and Written Opinion from International Application No. PCT/US2018/023414 dated May 24, 2019.

(Continued)

*Primary Examiner* — Benjamin R Shaw
(74) *Attorney, Agent, or Firm* — Dorsey & Whitney LLP

(57) ABSTRACT

Embodiments disclosed herein are directed towards noise reduction pipes, vacuum-assisted toilet systems including the same, and methods of using the same. An example noise reduction pipe includes a first end and a second end that is opposite the first end. The first end is configured to be coupled to an outlet of a toilet bowl and the second end is configured to be coupled to an inlet of a flush valve. The noise reduction pipe defines a fluid flow path that extends between the first end and the second end such that waste may flow from the first end to the second end. The noise reduction pipe also includes one or more bends. Each of the bends exhibits a radius of curvature that is greater than about 5 cm or a length that is greater than about 30 cm.

14 Claims, 7 Drawing Sheets

(58) Field of Classification Search
USPC ..... 4/420, 431
See application file for complete search history.

(56) References Cited

U.S. PATENT DOCUMENTS

| | | | | |
|---|---|---|---|---|
| 3,995,328 | A | 12/1976 | Carolan et al. | |
| 4,989,277 | A | 2/1991 | Tsutsui et al. | |
| 5,007,117 | A | 4/1991 | Oldfelt et al. | |
| 5,317,763 | A | 6/1994 | Frank et al. | |
| 5,469,586 | A | 11/1995 | Tsutsui et al. | |
| 5,604,938 | A | 2/1997 | Tyler | |
| 6,085,366 | A | 7/2000 | Pondelick et al. | |
| 6,385,789 | B1 * | 5/2002 | Pondelick | B64D 11/04 4/431 |
| 6,668,391 | B1 * | 12/2003 | Lee | E03D 11/02 4/421 |
| 6,910,231 | B2 | 6/2005 | Breiing et al. | |
| 7,207,073 | B1 * | 4/2007 | Blankenburg | E03F 1/006 4/321 |
| 8,370,969 | B2 | 2/2013 | Bowcutt et al. | |
| 10,683,652 | B1 | 6/2020 | Beach et al. | |
| 2003/0229939 | A1 | 12/2003 | Berman | |
| 2006/0137085 | A1 * | 6/2006 | Xiang | E03D 11/10 4/420 |
| 2006/0225200 | A1 | 10/2006 | Wierenga | |
| 2008/0060121 | A1 * | 3/2008 | Andreiu | E03D 11/18 4/300 |
| 2008/0185477 | A1 * | 8/2008 | Seibt | B64D 11/02 4/431 |
| 2008/0237397 | A1 | 10/2008 | Seibt | |
| 2009/0199332 | A1 * | 8/2009 | Mesun | E03D 11/08 4/420 |
| 2010/0313344 | A1 * | 12/2010 | Ina | E03D 11/16 4/252.1 |
| 2012/0066826 | A1 * | 3/2012 | Molina | E03D 11/13 4/434 |
| 2013/0099477 | A1 | 4/2013 | Horiguchi | |
| 2013/0305444 | A1 | 11/2013 | Boodaghians et al. | |
| 2015/0059075 | A1 | 3/2015 | Oxenfarth et al. | |
| 2016/0376779 | A1 * | 12/2016 | Boeltl | E03D 1/24 4/321 |
| 2017/0009438 | A1 | 1/2017 | Stachowski et al. | |
| 2017/0030063 | A1 * | 2/2017 | Godines | E03D 1/32 |
| 2017/0121955 | A1 * | 5/2017 | Hall | E03D 11/135 |
| 2017/0152657 | A1 | 6/2017 | Seimiya | |
| 2017/0247871 | A1 * | 8/2017 | Mukerji | E03D 11/18 |
| 2018/0355598 | A1 * | 12/2018 | Villalobos Lopez | E03D 11/08 |
| 2019/0257065 | A1 * | 8/2019 | Schibur | E03D 11/02 |
| 2020/0018055 | A1 * | 1/2020 | Garrels | E03D 11/18 |
| 2020/0378103 | A1 * | 12/2020 | Nakagawa | E03D 11/13 |
| 2021/0317649 | A1 * | 10/2021 | Helmstetter | E03D 11/13 |

FOREIGN PATENT DOCUMENTS

| | | | |
|---|---|---|---|
| CN | 104334452 | A | 2/2015 |
| CN | 106436864 | A | 2/2017 |
| DE | 102015214636 | A1 | 2/2017 |
| EP | 0679211 | B1 | 8/1996 |
| EP | 2365144 | A1 | 9/2011 |
| EP | 2365144 | A9 | 7/2012 |
| GB | 1063711 | A | 3/1967 |
| WO | 199511615 | A1 | 5/1995 |
| WO | 2020190302 | A1 | 9/2020 |

OTHER PUBLICATIONS

International Search Report and Written Opinion from International Application No. PCT/US2019/023410 dated Jun. 11, 2019.
International Search Report and Written Opinion from International Application No. PCT/US2019/023412 dated Jun. 11, 2019.
U.S. Appl. No. 16/967,521, filed Aug. 5, 2020.
U.S. Appl. No. 16/967,806, filed Aug. 6, 2020.
Non-Final Office Action for U.S. Appl. No. 16/967,806 dated Dec. 6, 2021.
Notice of Allowance for U.S. Appl. No. 16/967,521 dated Dec. 10, 2021.
Notice of Allowance for U.S. Appl. No. 16/967,521 dated Mar. 30, 2022.
Rose, et al., "Noise Reduction of a Vacuum-Assisted Toilet", Impact of Noise Control Engineering: 47th International Congress and Exposition on Noise Control Engineering, Aug. 2018, pp. 1314-1323.
Final Office Action for U.S. Appl. No. 16/967,806 dated Jul. 5, 2022.
Issue Notification for U.S. Appl. No. 17/967,521 dated Jul. 20, 2022.

* cited by examiner

NOISE REDUCTION PIPES, VACUUM-ASSISTED TOILET SYSTEMS INCLUDING THE SAME, AND METHODS OF USING THE SAME

BACKGROUND

Vacuum-assisted toilets are commonly used in airplanes, cruise ships, and other locations where water is scarce since vacuum-assisted toilets may operate using less water than other types of toilets. Vacuum-assisted toilets are also starting to be used in locations without the water restrictions of airplanes and cruise ships, such as in residential applications, to conserve water. However, vacuum-assisted toilets may generate loud noises when flushed. As such, users and manufactures of vacuum-assisted toilet continue to seek new and improved vacuum-assisted toilets and/or methods of using vacuum-assisted toilets.

SUMMARY

In an embodiment, a noise reduction pipe is disclosed. The noise reduction pipe includes a first end configured to be coupled to an outlet of a toilet bowl, a second end opposite the first end that is configured to be coupled to an inlet of a flush valve, a fluid flow path extending from the first end to the second end, and one or more bends between the first end and the second end. Each of the one or more bends exhibits a radius of curvature that is greater than about 5 cm.

In an embodiment, a vacuum-assisted toilet system is disclosed. The vacuum-assisted toilet system includes a toilet bowl defining an outlet. The vacuum-assisted toilet system also includes a flush valve configured to switch between an open state and a closed state. The flush valve includes an inlet. The vacuum-assisted toilet further includes a noise reduction pipe extending between the outlet of the toilet bowl and the inlet of the flush valve. The noise reduction pipe includes a first end coupled to the outlet of the toilet bowl and a second end coupled to the inlet of the flush valve. The noise reduction pipe defines a fluid flow path extending from the first end to the second end. The noise reduction pipe includes one or more bends between the first end and the second end. Each of the one or more bends exhibits a radius of curvature that is greater than about 5 cm. The vacuum-assisted toilet system additionally includes a vacuum source fluidly coupled to and positioned downstream from the flush valve.

In an embodiment, a vacuum-assisted toilet system is disclosed. The vacuum-assisted toilet system includes a toilet bowl defining an outlet. The vacuum-assisted toilet system also includes a flush valve configured to switch between an open state and a closed state. The flush valve includes an inlet. The vacuum-assisted toilet system further includes a noise reduction pipe extending between the outlet of the toilet bowl and the inlet of the flush valve. The noise reduction pipe includes a first end coupled to the outlet of the toilet bowl and a second end coupled to the inlet of the flush valve. The noise reduction pipe defines a fluid flow path extending from the first end to the second end. The noise reduction pipe further including one or more bends between the first end and the second end. The noise reduction pipe exhibits a length measured along a center of the fluid flow path that is greater than a distance between the outlet of the toilet bowl and the inlet of the flush valve. The vacuum-assisted toilet system additionally includes a vacuum source fluidly coupled to and positioned downstream from the flush valve.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

Figure 1:
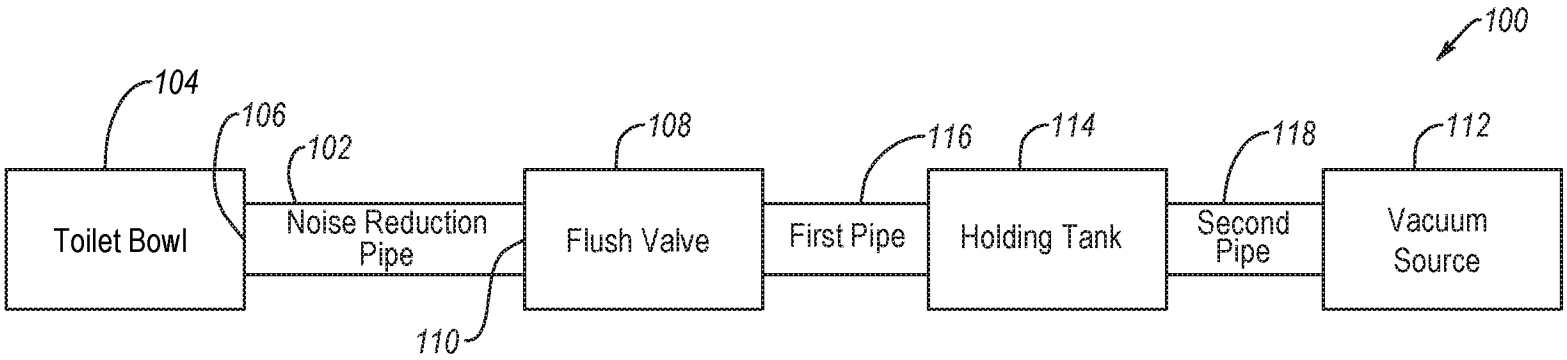
FIG. 1 is a schematic illustration of a vacuum-assisted toilet system that includes a noise reduction pipe, according to an embodiment.

Embodiments disclosed herein are directed towards noise reduction pipes, vacuum-assisted toilet systems including the same, and methods of using the same. An example noise reduction pipe includes a first end and a second end opposite the first end. The first end is configured to be coupled to an outlet of a toilet bowl and the second end is configured to be coupled to an inlet of a flush valve. The noise reduction pipe defines a fluid flow path that extends between the first end and the second end so waste may flow from the first end to the second end. As used herein, waste refers to urine, stool, water, toilet paper, air, etc. that is received by a toilet bowl and flows through the noise reduction pipe when a vacuum-assisted toilet system that includes the noise reduction pipe is flushed. The noise reduction pipe also includes one or more bends (e.g., a plurality of bends). Each bend exhibits a radius of curvature that is greater than about 5 cm or a length that is greater than about 30 cm.

The noise reduction pipe is configured to reduce the noise generated by a vacuum-assisted toilet system that includes the noise reduction pipe compared to a substantially similar vacuum-assisted toilet system that does not include the noise reduction pipe. For example, a conventional vacuum-assisted toilet system includes a toilet bowl and a flush valve attached to or otherwise positioned proximate to the toilet bowl. The conventional vacuum-assisted toilet system also includes a conventional pipe extending from an outlet of the toilet bowl to an inlet of the flush valve. Due to space restrictions, the conventional pipe exhibits a length as small as possible. For example, the conventional pipe exhibits a length of 20 cm or less (e.g., 15 cm or less). Further, to reduce the length of the conventional pipe, any bends in the conventional pipe exhibit a relatively sharp radius of curvature that is less than 4.5 cm. As used herein, the length of any of the pipes disclosed here is measured along a center of the flow path of the pipe and the radius of curvature of any of the bends disclosed herein is also measured along the center of the flow path. When the conventional vacuum-assisted toilet system is flushed, the conventional vacuum-assisted toilet system generates a loud noise at least partially caused by turbulent flow of waste through the conventional pipe and the flush valve. The turbulent flow of the waste generates a loud noise detectable at and/or near the toilet bowl (e.g., within one or two meters of a front edge of the toilet bowl).

The noise reduction pipe is configured to reduce the noise generated when a vacuum-assisted toilet system that includes a noise reduction pipe is flushed relative to the conventional vacuum-assisted toilet system that includes the conventional pipe for at least one of two reasons. First, it has been found that increasing the radius of curvature of the pipe extending between the outlet of the toilet bowl and the inlet of the flush valve may decreases the turbulent flow of the waste (e.g., makes the waste flow in a more laminar manner) therethrough. For example, it has been found that the relatively sharp radius of curvature of the one or more bends of a conventional pipe causes turbulent flow of the waste therethrough. The turbulent flow of the waste through the conventional pipes cause the conventional pipe to generate a loud noise which is detectable at and/or near the toilet bowl when waste flows therethrough. However, the noise reduction pipe includes one or more bends exhibiting a radius of curvature that is greater than about 5 cm (e.g., greater than about 9 cm) and may decrease the turbulent flow of the waste flowing through the noise reduction pipe relative to the conventional pipe. As such, the noise reduction pipe generates less noise than the conventional pipe during use.

Second, it has been found that increasing the length of the pipe extending between the outlet of the toilet bowl and the inlet of the flush valve decreases the noise generated by flushing the vacuum-assisted toilet system by acoustically insulating the toilet bowl from the flushing valve. For example, as discussed, waste flowing through the flush valve exhibits turbulent flow. However, increasing the length of any of the pipes disclosed herein acoustically insulates the toilet bowl from the flush valve by increasing the distance the noise must travel before the noise reaches the toilet bowl and can be detected. As discussed, the conventional pipe travels from the outlet of the toilet bowl to the inlet of the flush valve in a distance that is less than about 20 cm. As such, the conventional pipe only slightly acoustically insulates the toilet bowl from the flush valve. Meanwhile, the noise reduction pipe exhibits a length that is greater than about 30 cm due to, for example, the one or more bends formed therein. The increased length of the noise reduction pipe may cause the noise reduction pipes to acoustically insulate the toilet bowl from the flush valve better than the conventional pipe.

In an embodiment, the noise reduction pipe exhibits a shape that allows the noise reduction pipe to fit into unoccupied spaces of conventional vacuum-assisted toilet systems ("unoccupied spaces shape"). In an embodiment, designing the noise reduction pipe to exhibit an unoccupied spaces shape allows new vacuum-assisted toilet systems that include the noise reduction pipes to be used in locations that are configured to receive conventional vacuum-assisted toilet systems. For example, it may be difficult and/or cost preventive to redesign or reconfigure locations (e.g., such as airplanes or cruise ships) to receive a new vacuum-assisted toilet system that includes a noise reduction pipe that does not exhibit an unoccupied spaces shape. As such, designing the noise reduction pipe to exhibit the unoccupied spaces shape allows the new vacuum-assisted toilet system that includes the noise reduction pipe to be used in locations designed for conventional vacuum-assisted toilet systems. In an embodiment, designing the noise reduction pipe to exhibit an unoccupied spaces shape allows conventional vacuum-assisted toilet systems to be retrofitted to include the noise reduction pipe instead of the conventional pipe.

FIG. 1 is a schematic illustration of a vacuum-assisted toilet system 100 that includes a noise reduction pipe 102, according to an embodiment. The vacuum-assisted toilet system 100 includes a toilet bowl 104 defining an outlet 106. The vacuum-assisted toilet system 100 also includes a flush valve 108 configured to control waste flow from the toilet bowl 104. For example, the flush valve 108 may be configured to controllably switch between a closed state when the flush valve 108 restricts waste flow therethrough and an open state when the flush valve 108 allows waste flow therethrough. The noise reduction pipe 102 extends from and fluidly couples the outlet 106 of the toilet bowl 104 to an inlet 110 of the flush valve 108. The noise reduction pipe 102 includes at least one of one or more bends having a radius of curvature that is greater than about 5 cm or a length that is greater than about 30 cm. The vacuum-assisted toilet system 100 also includes a vacuum source 112 positioned downstream from the flush valve 108. The vacuum source 112 is configured to apply a vacuum to the toilet bowl 104 when the flush valve 108 is in its open state and pull waste from the toilet bowl 104 through the flush valve 108.

The toilet bowl 104 may include any suitable toilet bowl. For example, the toilet bowl 104 generally includes at least one concave portion configured to receive human waste (e.g., urine, stool, etc.) from an individual. The concave portion may also be configured to receive other types of waste, such as toilet paper, depending on the application of the toilet bowl 104. The toilet bowl 104 may also include a seat configured to support an individual. The seat may include at least one hole that allows human waste to enter the concave portion of the toilet bowl 104 while the individual is seated on the seat.

As discussed, the noise reduction pipe 102 fluidly couples the toilet bowl 104 to the flush valve 108. It is noted that the noise reduction pipe 102 may hold the waste instead of or with the toilet bowl 104 before the flush valve 108 switches to its open state.

The noise reduction pipe 102 may be formed from a plurality of pieces connected together or may include a single piece. Forming the noise reduction pipe 102 from a single piece may limit leaks in the noise reduction pipe 102 than if the noise reduction pipe 102 was formed from a plurality of pieces. Generally, the noise reduction pipe 102 is distinct from the toilet bowl 104. For example, the noise reduction pipe 102 may retrofit an existing vacuum-assisted toilet system. However, at least a portion of the noise reduction pipe 102 may be integrally formed with the toilet bowl 104. The noise reduction pipe 102 may be integrally formed with the toilet bowl 104, for example, when the vacuum-assisted toilet system 100 is made for residential applications and is at least partially formed from a single piece of porcelain. When the noise reduction pipe 102 is integrally formed with the toilet bowl 104, the noise reduction pipe 102 differs from the toilet bowl 104 because a width of the noise reduction pipe 102 is substantially constant (e.g., varies by at most 30%) whereas the width of the toilet bowl 104 generally varies. Also, the noise reduction pipe 102 is generally distinct from the flush valve 108. However, at least a portion of the noise reduction pipe 102 may be integrally formed with the flush valve 108. When the noise reduction pipe 102 is integrally formed with the flush valve 108, the noise reduction pipe 102 differs from the flush valve 108 because at least one of the flush valve 108 may form a bulge relative to the noise reduction pipe 102 or the noise reduction pipe 102 terminates at any portion of the flush valve 108 that may hold a moveable obstruction that adjustably restricts flow through the flush valve 108.

In an embodiment, as discussed, the noise reduction pipe 102 may include one or more bends exhibiting a radius of curvature measured along the center of the flow path. The radius of curvature of the one or more bends of the noise reduction pipe 102 may be greater than about 5 cm, such as greater than about 6 cm, greater than about 7 cm, greater than about 8 cm, greater than about 9 cm, greater than about 10 cm, greater than about 12 cm, greater than about 14 cm, greater than about 16 cm, or in ranges of about 5 cm to about 7 cm, about 6 cm to about 8 cm, about 7 cm to about 9 cm, about 8 cm to about 10 cm, about 9 cm to about 12 cm, about 10 cm to about 14 cm, or about 12 cm to about 16. For example, it has been found that increasing the radius of curvature of the one or more bends of the noise reduction pipe 102 to be greater than about 5 cm unexpectedly reduces the turbulent flow of the waste through the noise reduction pipe 102 thereby reducing the noise detected at and/or near the toilet bowl 104.

However, increasing the radius of curvature beyond a threshold value may have minimal effect on the turbulent flow of the waste through the noise reduction pipe 102. For example, in some embodiments, increasing the radius of curvature of one or more bends of the noise reduction pipe 102 to be greater than about 9 cm may have minimal effect on the turbulent flow of the waste through the noise reduction pipe 102. However, it is noted that the threshold value of the radius of curvature may depend on several factors, such as the length of the noise reduction pipe 102, inner diameter of the noise reduction pipe 102, and the vacuum (e.g., the pressure of the vacuum) that pulls the waste through the noise reduction pipe 102. As such, in some embodiments, the threshold may be greater than or less than about 9 cm for an about 5 cm diameter pipe. It is noted that, in some embodiments, it may be beneficial to select the radius of curvature to be at or above the threshold value so the noise reduction pipe 102 has the greatest effect on the noise generated by waste flowing therethrough.

As discussed, the noise reduction pipe 102 may exhibit a length measured along a center of a flow path defined thereby. The length of the noise reduction pipe 102 is greater (e.g., significantly greater) than a shortest possible path between the outlet 106 of the toilet bowl 104 and the inlet 110 of the flush valve 108 (e.g., the path closely followed by conventional pipes). For example, the length of the noise reduction pipe 102 is at least about 20% greater than the shortest possible path between the outlet 106 of the toilet bowl 104 and the inlet 110, such as at least about 30%, at least about 50%, at least about 75%, at least about 100%, at least about 150%, at least about 200%, at least about 250%, at least about 300%, at least about 350%, at least about 400%, or in ranges of about 20% to about 50%, about 30% to about 75%, about 50% to about 100%, about 75% to about 150%, about 100% to about 200%, about 150% to about 300%, or about 200% to about 400% greater than the shortest possible path between the outlet 106 of the toilet bowl 104 and the inlet 110 of the flush valve 108. The length of the noise reduction pipe 102 may be greater than the shortest possible path between the outlet 106 and the inlet 110 because the noise reduction pipe 102 includes the one or more bends therein. For example, the one or more bends formed in the noise reduction pipe 102 may allow the noise reduction pipe 102 to follow an indirect path between the outlet 106 and the inlet 110 thereby increasing the length of the noise reduction pipe 102.

Generally, the shortest possible path between the outlet 106 and the inlet 110 is about 10 cm to about 15 cm. As such, in some embodiments, the length of the noise reduction pipe 102 may be greater than about 30 cm, such as greater than about 35 cm, greater than about 40 cm, greater than about 45 cm, greater than about 50 cm, greater than about 55 cm, greater than about 60 cm, or in ranges of about 30 cm to about 40 cm, about 35 cm to about 45 cm, about 40 cm to about 50 cm, about 45 cm to about 55 cm, about 50 cm to about 60 cm, or about 55 cm to about 60 cm. For example, it has been found that increasing the length of the noise reduction pipe 102 to be greater than 30 cm unexpectedly reduces the amplitude of the noise detected at and/or near the toilet bowl 104 caused by turbulent flow of waste flowing through the flush valve 108 than at lengths that are less than 30 cm, especially at lengths that are less than 30 cm. Further, increasing the length of the noise reduction pipe 102 to be greater than 30 cm further reduces the amplitude of the noise detected at and/or near the toilet bowl 104 caused by turbulent flow of waste through the flush valve 108.

It has been found that increasing the length of the noise reduction pipe 102 to be greater than 60 cm may have minimal effect on the amplitude of the noise detected at and/or near the toilet bowl 104 caused by turbulent flow through the flush valve 108. For example, a noise reduction pipe having a length of 90 cm may only slightly reduce (e.g., by 1 or 2 decibels) the amplitude of the noise detected at and/or near the toilet bowl 104 caused by turbulent flow through the flush valve 108 compared to a substantially similar noise reduction pipe exhibiting a length of about 60 cm. However, it is noted that the noise reduction pipe 102 may exhibit a length that is greater than about 60 cm, for example, when the noise reduction pipe 102 exhibits an unoccupied space shape that requires the noise reduction pipe 102 to exhibit a length greater than 60 cm or the slight reduction in noise is desired.

The noise reduction pipe 102 may exhibit a diameter that is greater than about 0.5 cm, such as greater than about 1 cm, greater than about 2 cm, greater than about 3 cm, greater than about 4 cm, greater than about 5 cm, greater than about 6 cm, greater than about 7 cm, greater than about 8 cm, greater than about 10 cm, or in ranges of about 0.5 cm to about 2 cm, about 1 cm to about 3 cm, about 2 cm to about 4 cm, about 3 cm to about 5 cm, about 4 cm to about 6 cm, about 5 cm to about 7 cm, about 6 cm to about 8 cm, or about 7 cm to about 10 cm. In an example, increasing the diameter of the noise reduction pipe 102 may improve laminar flow of the waste flowing therethrough thereby decreasing the noise detected at and/or near the toilet bowl 104. In an example, as previously discussed, the diameter of the noise reduction pipe 102 may affect the threshold value of the radius of curvature and/or the length of the noise reduction pipe 102.

In an embodiment, the noise reduction pipe 102 may include one or more sharp bends therein instead of or in addition to the one or more bends exhibiting a radius of curvature that is greater than about 5 cm. As used herein, the one or more sharp bends are bends exhibiting a radius of curvature that is less than 4.5 cm. In an example, the noise reduction pipe 102 includes the one or more sharp bends at or near the second end of the noise reduction pipe 102 (e.g., at or near the portion of the noise reduction pipe 102 that connects to the flush valve 108). However, the sharp bends at or near the second end of the noise reduction pipe 102 may have a minimal effect on the amplitude of the noise generated at and/or near the toilet bowl 104 because the length of the noise reduction pipe 102 acoustically insulates the sharp bends from the toilet bowl 104. In an example, the noise reduction pipe 102 may include one or more sharp bends when the noise reduction pipe 102 exhibits an unoccupied space shape that requires the noise reduction pipe 102 to exhibit one or more sharp bends.

Figure 3:
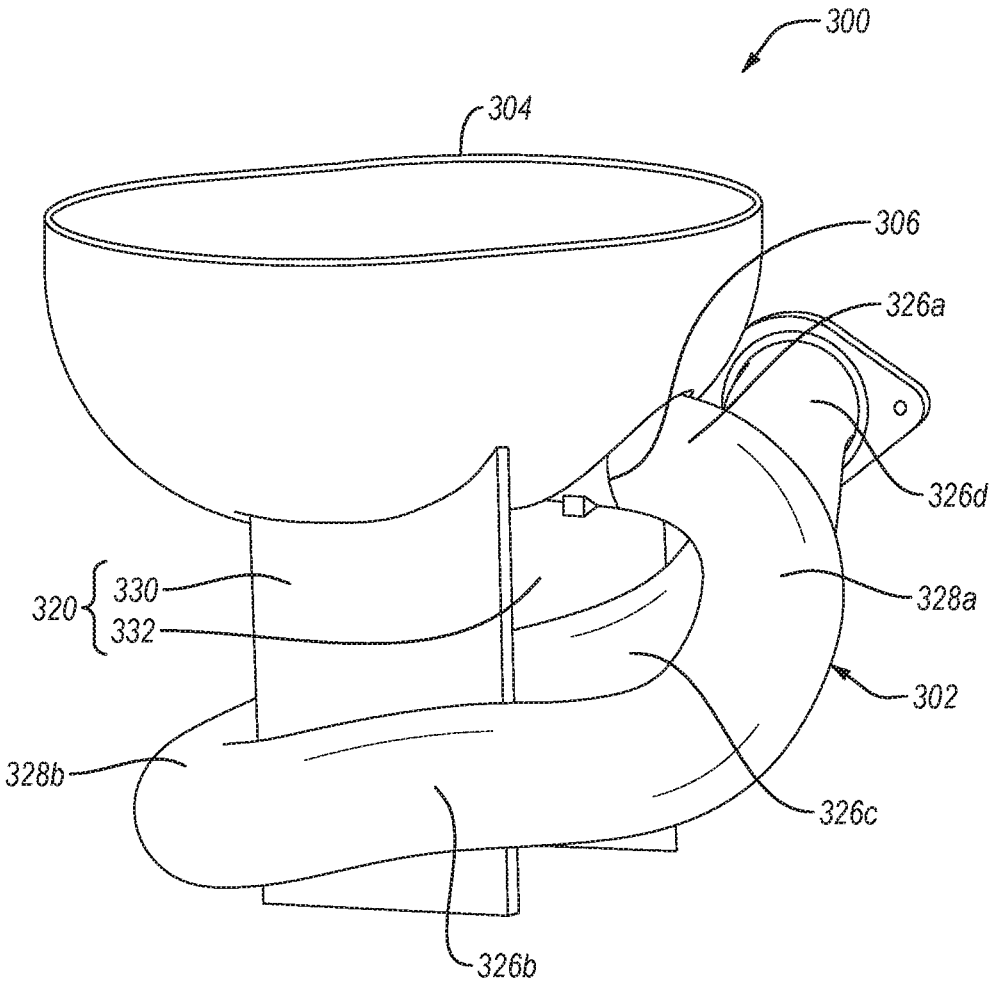
FIG. 3 is an isometric view of a vacuum-assisted toilet system that includes a noise reduction pipe, according to an embodiment.

In an embodiment, the noise reduction pipe 102 is a rigid pipe. The noise reduction pipe 102 is rigid when the noise reduction pipe 102 resists deformation and/or exhibits, for example, a modulus of elasticity that is greater than polyethylene. When the noise reduction pipe 102 is a rigid pipe, the noise reduction pipe 102 may be manufactured (e.g., via 3D printing or injection molding) to exhibit a selected shape, such as the unoccupied space shape. The rigid pipe may be formed in two or more pieces that are configured to be attached together which may facilitate placement of the rigid pipe, for example, when the rigid pipe needs to be placed around or through obstacles (e.g., placed through the base 320 as shown in FIG. 3). In an embodiment, the noise reduction pipe 102 is a flexible pipe (e.g., corrugated flexible pipe). The noise reduction pipe 102 is flexible when the noise reduction pipe 102 can be easily deformed into a selected shape and/or maintains the deformed shape after a force is removed therefrom. When the noise reduction pipe 102 is flexible, the noise reduction pipe 102 need not be manufactured into a selected shape. Instead, the noise reduction pipe 102 may be deformed on-site to the selected shape thereof which may allow the noise reduction pipe 102 to be custom-fit into the unoccupied space shape and/or placed through certain spaces (e.g., through the base 320 as shown in FIG. 3).

The noise reduction pipe 102 may be configured to be connected to the outlet 106 of the toilet bowl 104 and the inlet 110 of the flush valve 108 using any suitable technique. In an example, the noise reduction pipe 102 is configured to be connected to at least one of the outlet 106 or the inlet 110 using a threaded connection, bolts or other suitable mechanical fasteners, or via press-fitting.

The flush valve 108 may include any suitable valve. For example, the flush valve 108 may include a ball valve, a butterfly valve, a solenoid, or any other suitable valve. Depending on the type of valve that forms the flush valve 108, the flush valve 108 may include a body forming the inlet 110 and an outlet. The flush valve 108 also may also include a moveable obstruction in the body that adjustably restricts fluid flow through the flush valve 108. The moveable obstruction restricts fluid flow through the flush valve 108 when the flush valve 108 is in the closed state and allows fluid flow through the flush valve 108 when the flush valve 108 is in the open state.

The flush valve 108 also includes (e.g., is integrally formed with or is mechanically coupled to) a valve actuator configured to switch the flush valve 108 between the open state and the closed state. For example, activating the valve actuator may move the moveable obstruction of the flush valve 108 from a position that restricts waste flow through the flush valve 108 to a position that allows waste flow through the flush valve 108, and/or vice versa. The valve actuator may include any actuator that may switch the flush valve 108 between the closed state and the open state. For example, the flush valve 108 may be an electric motor, an electrical energy supply (e.g., when the flush valve 108 is a solenoid), or any other suitable actuator.

Conventional vacuum-assisted toilet systems generally have a flush valve positioned near or adjacent to the toilet bowl thereof. For example, the flush valve of conventional vacuum-assisted toilet systems may be at least one of attached to the toilet bowl, attached to a structure that supports the toilet bowl, attached to a structure attached to the toilet bowl, or positioned within 15 cm of the toilet bowl (e.g., positioned within 15 cm of the outlet of the toilet bowl). In an embodiment, the flush valve 108 may be positioned near or adjacent to the toilet bowl 104 like any of flush valves of the conventional vacuum-assisted toilet systems discussed above. In such an embodiment, the vacuum-assisted toilet system 100 may be used in locations configured to receive the conventional vacuum-assisted toilet systems. For instance, it may be difficult and/or expensive to redesign or modify an existing airplane or cruise ship design to accommodate the vacuum-assisted toilet system 100 if the flush valve 108 is spaced from the toilet bowl 104. Further, positioning the flush valve 108 proximate to the toilet bowl 104 may allow the vacuum-assisted toilet system 100 to be formed by retrofitting a conventional vacuum-assisted toilet system to include at least some features disclosed herein (e.g., include the noise reduction pipe 102). However, in an embodiment, the flush valve 108 may be spaced from the toilet bowl 104.

The vacuum-assisted toilet system 100 may include or be fluidly coupled to a waste collection system (e.g., a holding tank 114, a sewer system, a septic tank, etc.). For instance, the flush valve 108 may be fluidly coupled to the waste collection system. In an embodiment, the vacuum-assisted toilet system 100 is configured to be used on an airplane, a cruise ship, or another location not connected to a sewer system, sceptic tank, or other suitable alternatives. In such an embodiment, the waste collection system includes at least one holding tank 114. The holding tank 114 is fluidly coupled to the flush valve 108 and defines an interior space configured to receive and store the waste in an at least substantially fluid tight manner.

In an embodiment, the holding tank 114 may be fluidly connected to the flush valve 108 via a first pipe 116. The first pipe 116 may extend between the flush valve 108 and the holding tank 114. In an embodiment, the first pipe 116 may be omitted from the vacuum-assisted toilet system 100, for example, when the flush valve 108 is adjacent to or integrally formed with the holding tank 114. The holding tank 114 may also be fluidly connected to the vacuum source 112, for example, via a second pipe 118 (e.g., the second pipe 118 extends between the holding tank 114 and the vacuum source 112). In an embodiment, the second pipe 118 may be omitted from the vacuum-assisted toilet system 100, for example, when the holding tank 114 is adjacent to or integrally formed with the vacuum source 112.

It is noted that the holding tank 114 may be omitted from the vacuum-assisted toilet system 100, for example, when the waste collection system includes a sewer system, a septic tank, etc. For example, the holding tank 114 may be omitted from the vacuum-assisted toilet system 100 when the vacuum-assisted toilet system 100 is configured to be used in a residential application since, generally, residential buildings are connected to sewer systems, septic tanks, etc. When the holding tank 114 is omitted from the vacuum-assisted toilet system 100, the first pipe 116 may extend from the flush valve 108 towards the vacuum source 112 or the flush valve 108 may be positioned adjacent to or integrally formed with the vacuum source 112.

As discussed, the vacuum-assisted toilet system 100 includes a vacuum source 112 configured to apply a vacuum (e.g., a pressure significantly less than room pressure) to one or more components of the vacuum-assisted toilet system 100 depending on whether the flush valve 108 is in its respective open or closed state. In the illustrated embodiment, the vacuum source 112 is configured to apply the vacuum to the holding tank 114 so an interior space of the holding tank 114 exhibits the vacuum. Causing the interior space of the holding tank 114 to exhibit the vacuum may facilitate pulling the waste into the holding tank 114. The vacuum source 112 may also apply the vacuum to at least a downstream side of the flush valve 108. When the flush valve 108 is in the open state, the vacuum source 112 also applies the vacuum to the toilet bowl 104 pulling the waste into the holding tank 114.

It is noted that, when the waste collection system does not include the holding tank 114, the vacuum source 112 may be positioned between the flush valve 108 and the sewer system, septic tank, etc. The vacuum source 112 may apply a vacuum to a location between the flush valve 108 and the sewer system, septic tank, etc. thereby pulling the waste to the location and towards the sewer system, septic tank, etc.

The type of vacuum source 112 used in the vacuum-assisted toilet system 100 may depend on the application of the vacuum-assisted toilet system 100. In an embodiment, the vacuum source 112 may be a vacuum pump, for example, when the vacuum source 112 is used in a cruise ship, a residential application, etc. In an embodiment, when the vacuum-assisted toilet system 100 is used in an airplane, the vacuum source 112 may be an exterior of an airplane. For example, during flight, an interior of the airplane may exhibit a pressure (e.g., room pressure) of about 0.7 atmospheres to about 1.0 atmospheres while an exterior of the plane exhibits a pressure of about 0.4 atmospheres or less at a cruising altitude of about 35,000 feet. In other words, relative to the pressure of the interior of the airplane, the exterior of the airplane is a vacuum. The exterior of the airplane may be the vacuum source 112 and the second pipe 118 may extend from the holding tank 114 to an exterior of the airplane. However, it is noted that, the vacuum source 112 may include a vacuum pump instead of or with the exterior of the airplane when the vacuum-assisted toilet system 100 is used in an airplane. In an embodiment, the vacuum source 112 may be integrally formed with a water tank. For example, emptying the water tank may, when the water tank is substantially fluid tight, create a vacuum in the water tank. The vacuum in the water tank may then be used to remove the waste (e.g., including the water originally in the water tank) from the toilet bowl 104.

The vacuum-assisted toilet system 100 may include one or more additional components. For example, the vacuum-assisted toilet system 100 may include one or more of at least one additional valve, a high pressure source, a controller that at least partially controls the operation of one or more components of the vacuum-assisted toilet system 100, one or more additional flush valves, a water source, a water actuator, etc. as disclosed in Application No. TBD entitled Vacuum-Assisted Toilet Systems and Methods of Using the Same filed on TBD ( PCT/US19/23410) and/or Application No. TBD entitled Vacuum-Assisted Toilet Systems and Methods of Using the Same filed on TBD ( PCT/US19/23412), the disclosure of each of which is incorporated herein, in its entirety, by this reference.

Figure 2A:
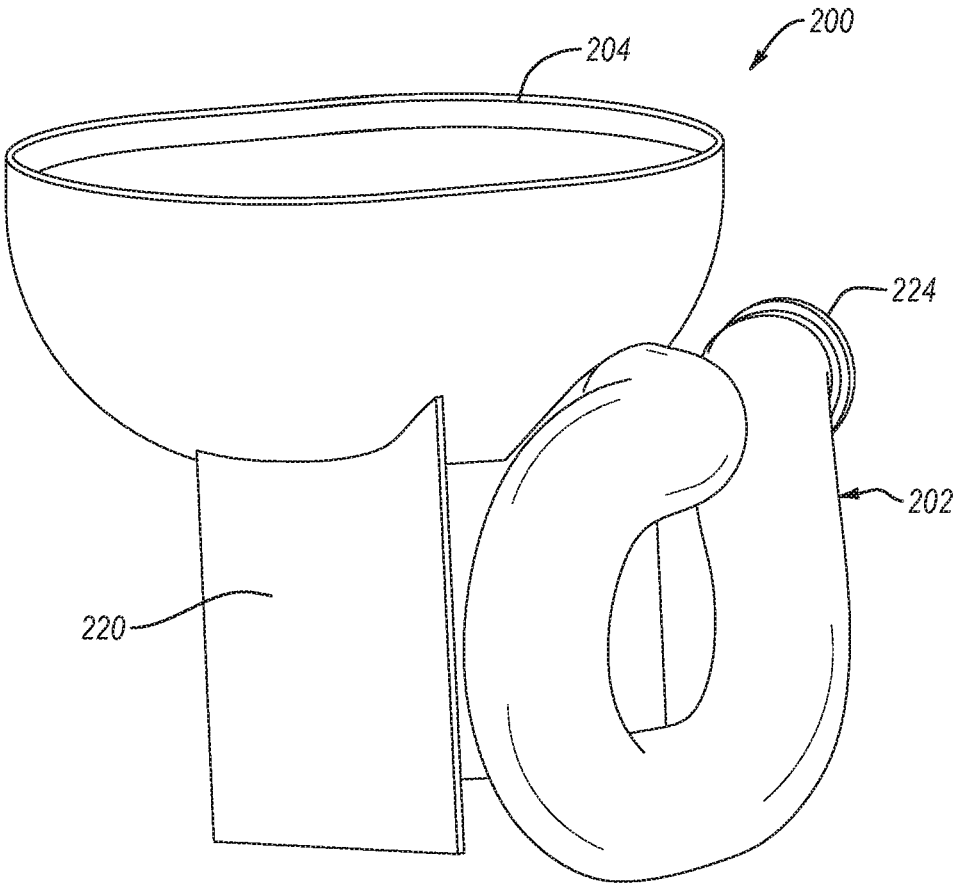
FIG. 2A is an isometric view of a vacuum-assisted toilet system, according to an embodiment.

FIG. 2A is an isometric view of a vacuum-assisted toilet system 200, according to an embodiment. Except as otherwise disclosed herein, the vacuum-assisted toilet system 200 includes a toilet bowl 204 having an outlet (not shown, obscured). The toilet bowl 204 may be supported above a surface (e.g., ground or floor) by a base 220. The vacuum-assisted toilet system 200 also includes a noise reduction pipe 202 extending from the outlet towards a flush valve (not shown). The noise reduction pipe 202 includes a first end 222 (FIG. 2B) that is configured to be attached to the outlet of the toilet bowl 204 and an opposing second end 224 configured to be attached to the flush valve.

In an embodiment, the area under the toilet bowl 204 and, possibly, an area extending a slight distance radially from the toilet bowl 204 may be an unoccupied space. Further, the shortest path from the outlet of the toilet bowl 204 to the flush valve may also be unoccupied space. As such, the noise reduction pipe 202 may exhibit an unoccupied space shape configured to fit within the unoccupied space.

Figure 2B:
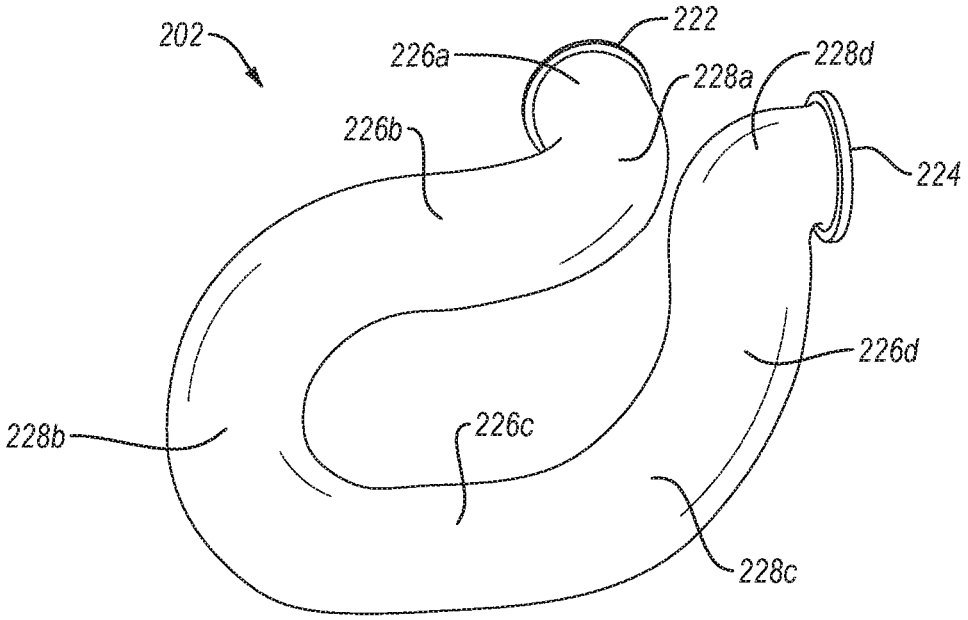
FIG. 2B is a side view of the noise reduction pipe exhibiting an unoccupied space shape configured to fit into the unoccupied portion of the vacuum-assisted toilet system, according to an embodiment.

FIG. 2B is a side view of the noise reduction pipe 202 exhibiting an unoccupied space shape configured to fit into the unoccupied portion of the vacuum-assisted toilet system 200, according to an embodiment. For example, the noise reduction pipe 202 may include a first portion 226*a* extending from the first end 222 and away from the outlet of the toilet bowl 204. The first portion 226*a* may extend for a short distance away from the toilet bowl 204 to a first bend 228*a* so the noise reduction pipe 202 remains in the unoccupied space of the vacuum-assisted toilet system 200. The noise reduction pipe 202 may include a second portion 226*b* extending from the first bend 228*a* to a second bend 228*b*. The second portion 226*b* may remain generally parallel to the surface thus increasing the length of the noise reduction pipe 202. The noise reduction pipe 202 may include a third portion 226*c* that extends from the second bend 228*b* to a third bend 228*c*. Similar to the second portion 226*b*, the third portion 226*c* may be generally parallel to the surface. However, the third portion 226*c* may be more proximate to the surface (e.g., adjacent to the surface) than the fourth portion 226*d*. The fourth portion 226*d* may extend upwardly from the third bend 228*c* so the second end 224 is proximate to the inlet of the flush valve which, in many embodiments, is space above the surface (e.g., spaced above the ground or floor). The third portion 226*c* may extend from the third bend 228*c* to a fourth bend 228*d*. In the illustrated embodiment, the second end 224 of the noise reduction pipe 202 is at the fourth bend 228*d*. However, it is noted that the noise reduction pipe 202 may include one or more portions extending from the fourth bend 228*d* (along with any accompanying bends) to the second end 224.

In an embodiment, all of the bends of the noise reduction pipe 202 (e.g., all of the first, second, third, and fourth bends 228*a*, 228*b*, 228*c*, 228*d*) exhibit a radius of curvature that is greater than about 5 cm. In an embodiment, at least one bend of the noise reduction pipe 202 exhibits a radius of curvature that is less than 4.5 cm (e.g., is a sharp bend). For example, as illustrated, the fourth bend 228*d* exhibits a radius of curvature that is less than 4.5 cm. However, since the fourth bend 228*d* is spaced from the toilet bowl 204 by substantially all of the length of the noise reduction pipe 202, any noise generated by flowing waste through the fourth bend 228*d* is partially acoustically insulated by the length of the noise reduction pipe 202.

Referring back to FIG. 2A, the noise reduction pipe 202 exhibits a length significantly greater than the shortest path between the outlet of the toilet bowl 204 and the inlet of the flush valve. As such, the noise reduction pipe 202 acoustically insulates the toilet bowl 204 from noise generated by turbulent flow of waste through the flush valve better than a conventional pipe that follows or substantially follows the shortest path between the outlet of the toilet bowl 204 and the inlet of the flush valve.

FIG. 3 is an isometric view of a vacuum-assisted toilet system 300 that includes a noise reduction pipe 302, according to an embodiment. Except as otherwise disclosed herein, the vacuum-assisted toilet system 300 may be the same as or substantially similar to any of the vacuum-assisted toilet systems disclosed herein. For example, the vacuum-assisted toilet system 300 includes a toilet bowl 304 defining an outlet (not shown). The vacuum-assisted toilet system 300 also includes a base 320 that supports the toilet bowl 304 above a surface.

In an embodiment, similar to the vacuum-assisted toilet system 300 of FIG. 2A, the area under the toilet bowl 304 and, possibly, an area extending a slight distance radially from the toilet bowl 304 may be an unoccupied space. Further, the shortest path from the outlet of the toilet bowl 304 to the flush valve may also be unoccupied space. Additionally, the base 320 may define an unoccupied space. In an example, as illustrated, the base 320 may include a front plate 330 and a back plate 332 and a space therebetween. In an example, the base 320 may be substantially hollow thereby allowing a hole to be formed therein through which the noise reduction pipe 302 may be positioned through.

The noise reduction pipe 302 may exhibit an unoccupied space shape configured to fit within these unoccupied spaces. For example, the noise reduction pipe 302 may include a first portion 326*a* extending from the first end (not shown, obscured) of the noise reduction pipe 302 and away from the outlet of the toilet bowl 304. The first portion 326*a* may extend for a short distance away from the toilet bowl 304 to a first bend 328*a* so the noise reduction pipe 302 remains in the unoccupied space of the vacuum-assisted toilet system 300. The first bend 328*a* may be configured and selected to curve the noise reduction pipe 302 to a forward facing side of the front plate 330. The noise reduction pipe 302 may include a second portion 326*b* extending from the first bend 328*a* to a second bend 328*b*. The second portion 326*b* may have a length sufficient to extend across the front plate 330 and may be selected so the second bend 328*b* is at or near the surface to maximize a length of the noise reduction pipe 302. The second bend 328*b* may be configured to curve the noise reduction pipe 302 around the front plate 330. The noise reduction pipe 302 may include a third portion 326*c* that extends from the second bend 328*b* to a third bend (not shown, obscured). The third portion 326*c* may be selected to extend through the gap between the front and back plates 330, 332. The third bend may curve the noise reduction pipe 302 towards the inlet of the flush valve. The noise reduction pipe 302 may further include a fourth portion 326*d* that extends from the third bend towards the inlet of the flush valve.

Figure 4:
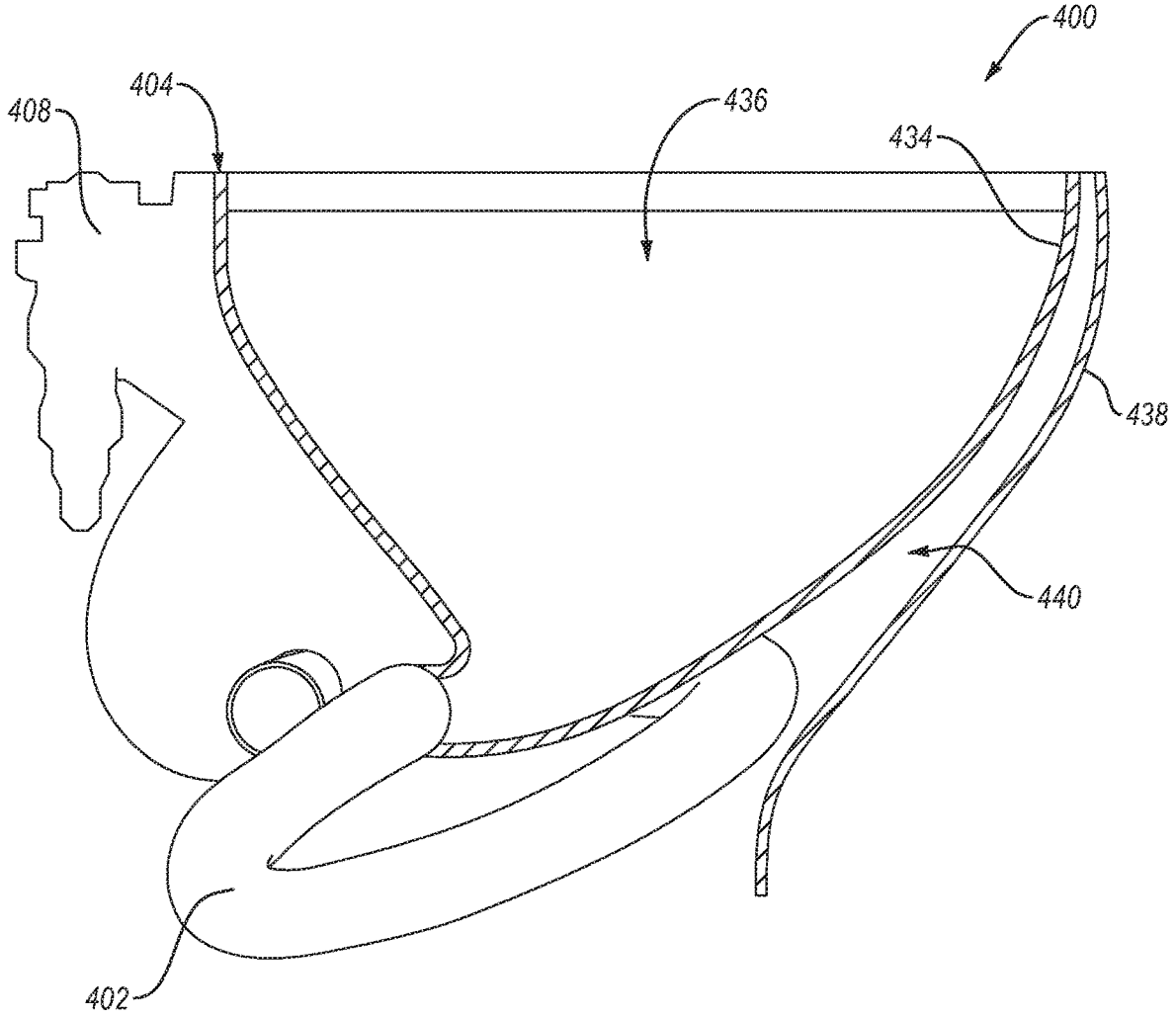
FIG. 4 is a partially cross-sectional side view of a vacuum-assisted toilet system that includes a noise reduction pipe, according to an embodiment.

FIG. 4 is a partially cross-sectional side view of a vacuum-assisted toilet system 400 that includes a noise reduction pipe 402, according to an embodiment. Except as otherwise disclosed herein, the vacuum-assisted toilet system 400 may be the same as or substantially similar to any of the vacuum-assisted toilet systems disclosed herein. For example, the vacuum-assisted toilet system 400 includes a toilet bowl 404 defining an outlet (not shown, obscured) and a flush valve 408.

The toilet bowl 404 includes an inner wall 434 defining an inner region 436 of the toilet bowl 404 configured to receive and hold waste. The toilet bowl 404 also includes an outer wall 438. The inner wall 434 and the outer wall 438 define a gap 440 therebetween. The gap 440 may be an unoccupied space. As such, the noise reduction pipe 402 may be configured to at least partially extend through the gap 440. For example, the noise reduction pipe 402 may extend from the outlet of the toilet bowl 404. The noise reduction pipe 402 may then exhibit a curve at, near, or a short distance from the outlet. The at least a portion of the curve of the noise reduction pipe 402 may be configured to substantially follow the inner wall 434 and/or the outer wall 438 so the noise reduction pipe 402 fits within the gap 440.

Figure 5:
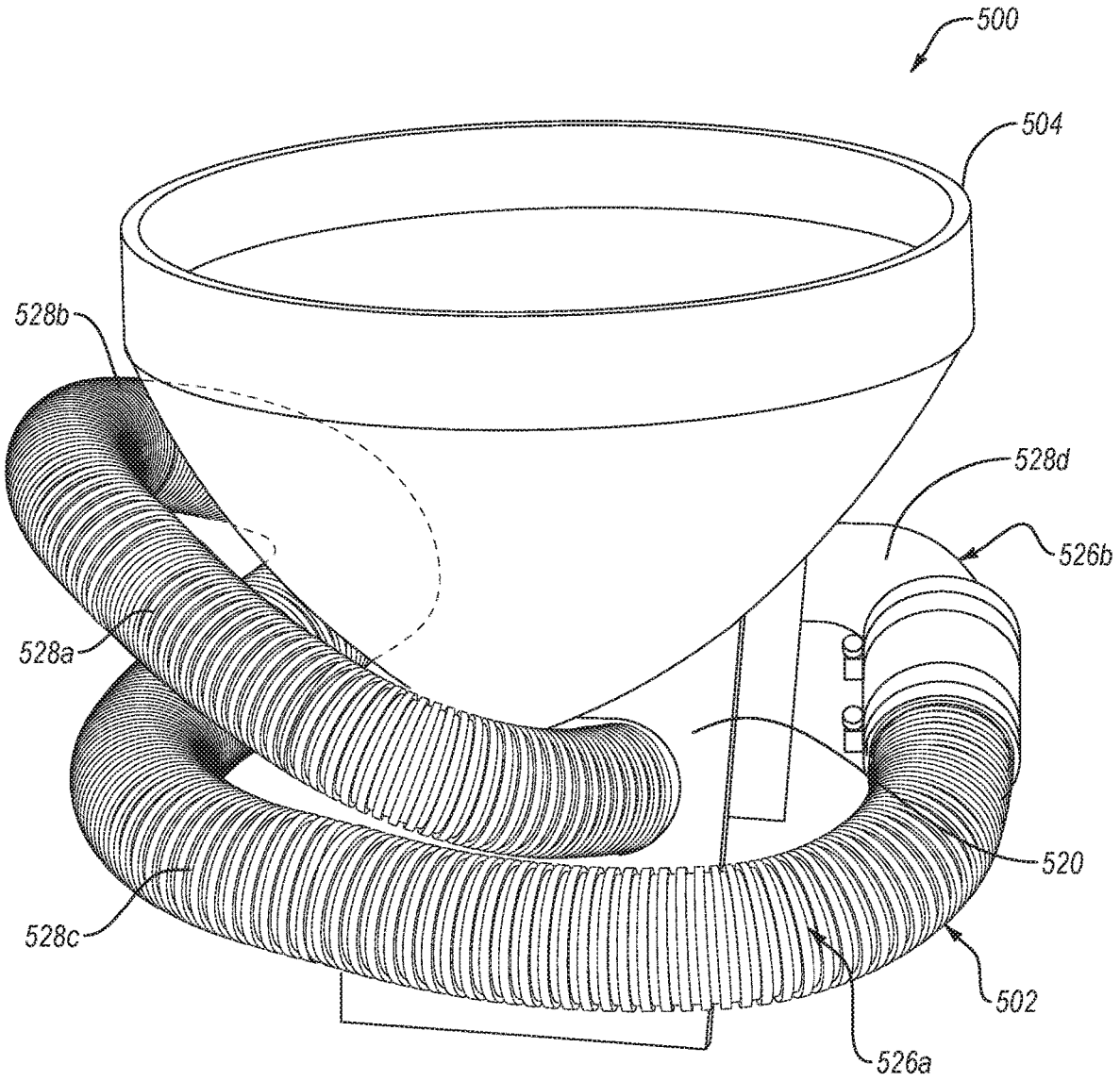
FIG. 5 is an isometric view of a vacuum-assisted toilet system that includes a noise reduction pipe (obscured portions of the noise reduction pipe are shown with phantom lines), according to an embodiment.

FIG. 5 is an isometric view of a vacuum-assisted toilet system 500 that includes a noise reduction pipe 502 (obscured portions of the noise reduction pipe 502 are shown with phantom lines), according to an embodiment. Except as otherwise disclosed herein, the vacuum-assisted toilet system 500 is the same or substantially the same as any of the other vacuum-assisted toilet systems disclosed herein. For example, the vacuum-assisted toilet system 500 may include a toilet bowl 504 defining an outlet (not shown, obscured), a base 520, and the noise reduction pipe 502 extending from the outlet of the toilet bowl.

As discussed, the noise reduction pipe 502 may include a flexible pipe or a rigid pipe. In the illustrated embodiment, the noise reduction pipe 502 may include both a flexible pipe and a rigid pipe. For example, the noise reduction pipe 502 may include a first portion 526*a* extending from the first end 522 that is flexible (e.g., formed from a corrugated flexible pipe) which allows the first portion 526*a* to be positioned in the unoccupied space under or substantially under the toilet bowl 504. The noise reduction pipe 502 may also include a second portion 526*b* extending from the second end 524 that is a rigid pipe which may facilitate attachment to the flush valve. The first and second portions 526*a*, 526*b* may be coupled together.

The noise reduction pipe 502 may include a first bend 528*a* that is configured to maintain the noise reduction pipe 502 under or substantially under the toilet bowl 504 and to loop the noise reduction pipe 502 to the side or rear of the base 520. The noise reduction pipe 502 may include a second bend 528*b* that is configured to maintain the noise reduction pipe 502 under or substantially under the toilet bowl 504 and to loop the noise reduction pipe 502 about 180° (±45°) so, after the second bend 528*b*, the noise reduction pipe 502 extends in a generally opposing direction than before the second bend 528*b*. The noise reduction pipe 502 may then include a third bend 528*c* that is configured to maintain the noise reduction pipe 502 under or substantially under the toilet bowl 504. The third bend 528*c* may end at or near a location where the first portion 526*a* and the second portion 526*b* meet. The noise reduction pipe 502 may then include a fourth bend 528*d* that is configured to allow the second end 524 of the noise reduction pipe 502 to be positioned adjacent to an inlet of the flush valve so the noise reduction pipe 502 can be connected to the flush valve.

The noise reduction pipes 202, 302, 402, and 502 shown in FIGS. 2A-5 are merely examples of some possible unoccupied spaces shapes that any of the noise reduction pipes disclosed herein may exhibit. However, it is noted that the noise reduction pipes disclosed herein may exhibit any other suitable unoccupied space shape. For example, the noise reduction pipes may exhibit any other suitable shape configured to fit within unoccupied spaces that are at least one of under or substantially under the toilet bowl, within or defined by the base, within the toilet bowl (e.g., between the inner and outer walls of the toilet bowl), or any other suitable unoccupied space. It is also noted that the noise reduction pipes disclosed herein may not exhibit an unoccupied space shape.

The following working examples provide further detail in connection with the specific vacuum-assisted toilet systems disclosed herein.

Working Example 1

The vacuum-assisted toilet system of the working example 1 included a toilet bowl defining an outlet, a flush valve having an inlet, a holding tank fluidly coupled to the flush valve via a first pipe, and a vacuum pump fluidly coupled to the holding tank via a second pipe so an interior space of the holding tank is exposed to a vacuum. A microphone was disposed in or near the toilet bowl to detect the noise generated during use of the vacuum-assisted toilet system.

Figure 6:
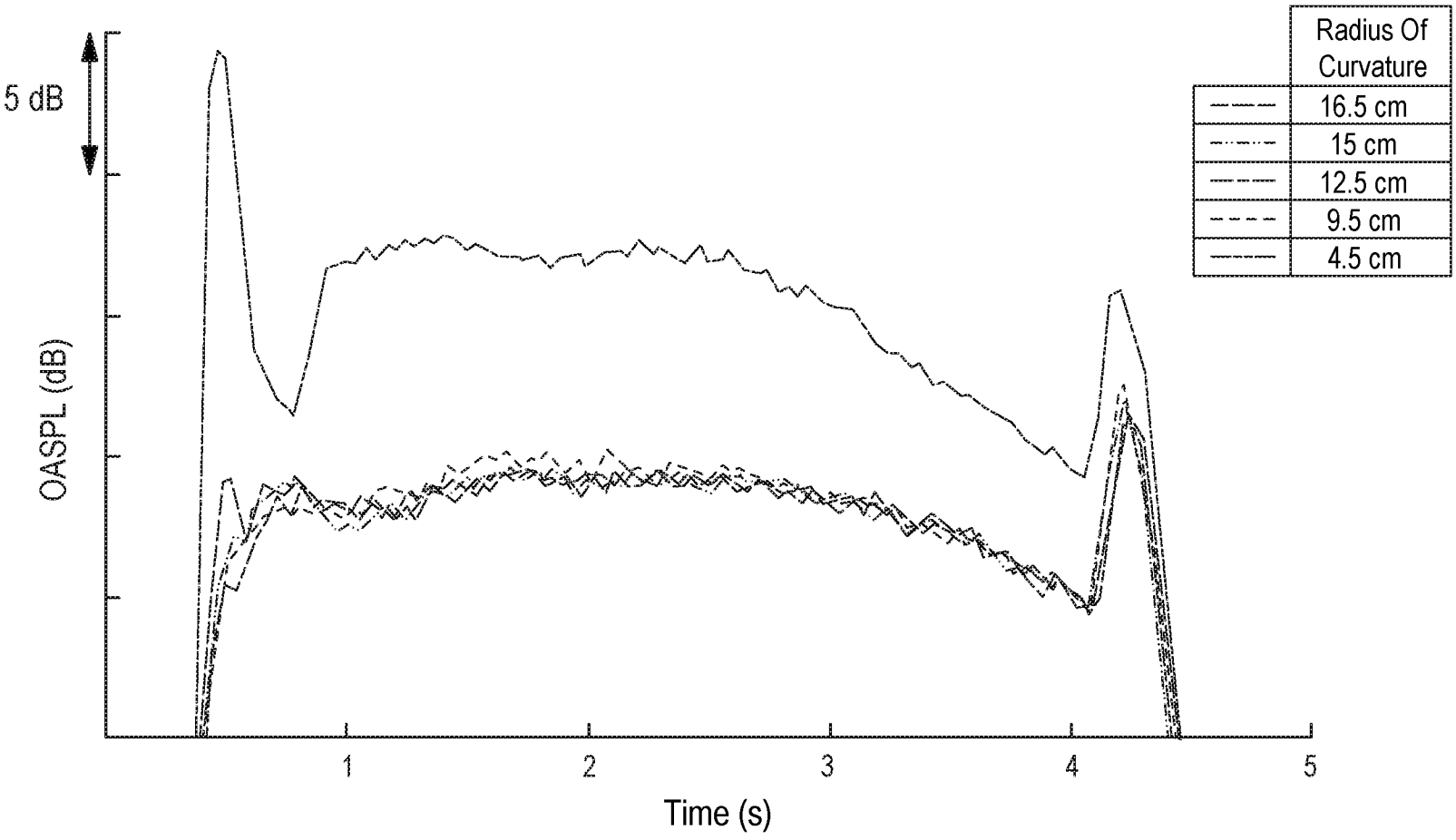
FIG. 6 is a graph illustrating the noise (in decibels) over time after flushing the vacuum-assisted toilet system of working example 1 using the plurality of different pipes.

A plurality of different pipes were used to fluidly couple the outlet of the toilet bowl to the inlet of the flush valve. Each of the pipes included a bend therein having different radius of curvature. One of the pipes was a conventional pipe (e.g., a pipe having a radius of curvature that was less than 4.5 cm) and the rest of the pipes were noise reduction pipes (e.g., pipes having a radius of curvature that is greater than 5 cm). The radius of curvature for each of the pipes is shown in FIG. 6. Each of the pipes had a length of about 170 cm and a diameter of about 5 cm and was structurally similar to the pipe 502 of FIG. 5. Tests were performed using each of the pipes by flushing the vacuum-assisted toilet system to determine the noise generated by flowing waste through each of the pipes.

FIG. 6 is a graph illustrating the noise (in decibels) over time after flushing the vacuum-assisted toilet system of working example 1 using the plurality of different pipes. FIG. 6 illustrates that the conventional pipe that included a bend having a radius of curvature of 4.5 cm exhibited two spikes in the amplitude of the detected noise at about 0.5 seconds and about 4.2 seconds. These spikes in the detected noise were generated by switching the flush valve between the open and closed states thereof. However, FIG. 6 demonstrates that each of the noise reduction pipes eliminated or substantially eliminated the spike in the amplitude of the detected noise at about 0.5 seconds and noticeably reduced the amplitude of the detected noise at 4.2 seconds. For example, FIG. 6 demonstrates that the noise reduction pipes reduced the amplitude of the detected noise by at least about 15 decibels at 0.5 seconds and by at least about 3 decibels at 4.2 seconds. FIG. 6 also demonstrates that each of the noise reduction pipes reduced the amplitude of the detected noise by about 4-9 decibels for most of the time between 0.5 second and 4.2 seconds. As such, FIG. 6 demonstrates that increasing the radius of curvature of the pipes to be greater than about 5 cm reduces the amplitude of the detected noise.

However, FIG. 6 also demonstrates that increasing the radius of curvature beyond a threshold value does not significantly reduce the amplitude of the detected noise. The threshold value of the radius of curvature for the specific pipes of the working example used in the specific vacuum-assisted toilet system of the working example is about 9.5 cm. However, as discussed, the threshold value of the radius of curvature may vary depending on the specific pipes and the specific vacuum-assisted toilet system.

Working Example 2

The vacuum-assisted toilet system of the working example 2 included a toilet bowl defining an outlet, a flush valve having an inlet, a holding tank fluidly coupled to the flush valve via a first pipe, and a vacuum pump fluidly coupled to the holding tank via a second pipe so an interior space of the holding tank is exposed to a vacuum. A microphone was disposed in or near the toilet bowl to detect the noise generated during use of the vacuum-assisted toilet system.

Figure 7:
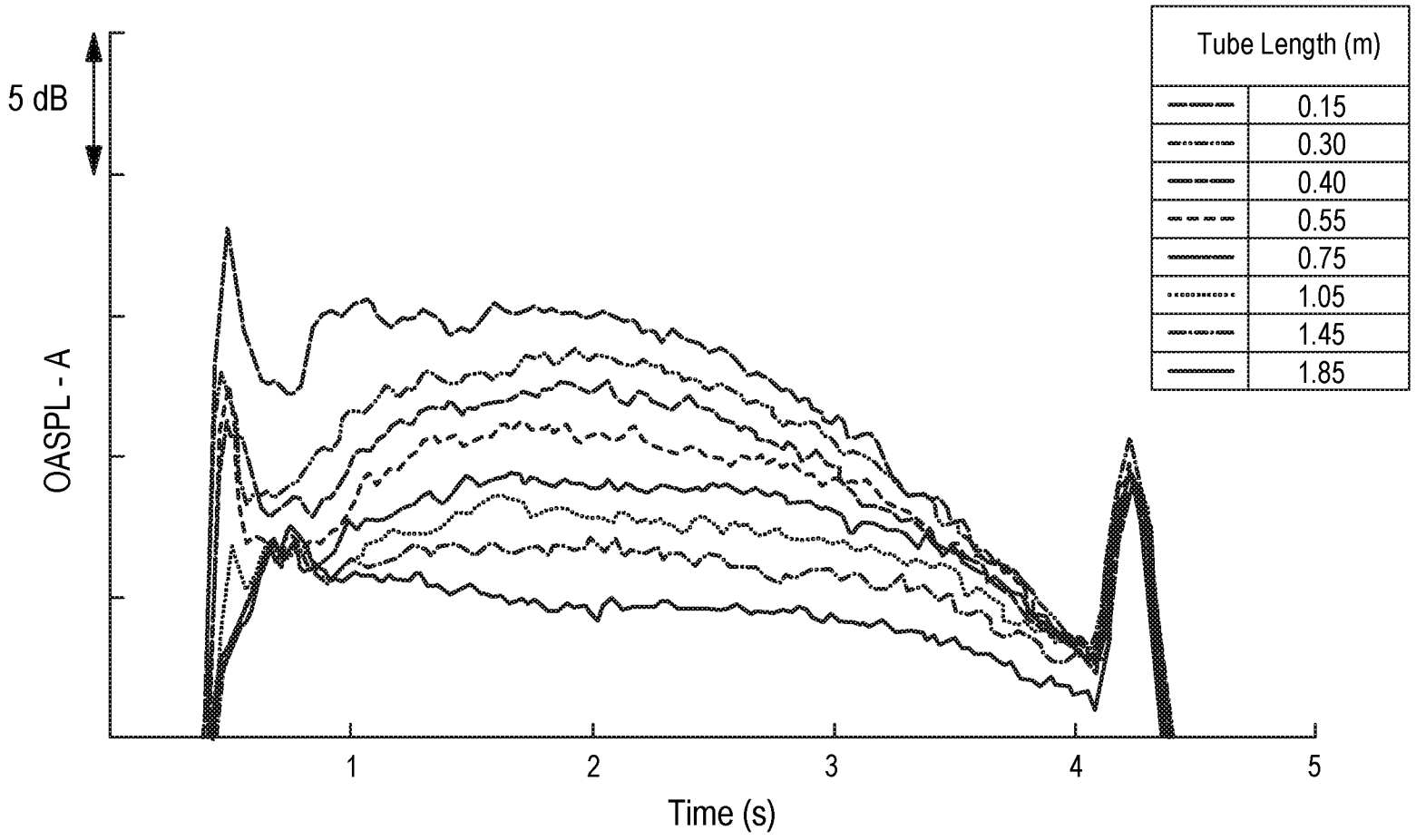
FIG. 7 is a graph illustrating the noise (in decibels) over time after flushing the vacuum-assisted toilet system of working example 2 using the plurality of different pipes.

A plurality of different pipes were used to fluidly couple the outlet of the toilet bowl to the inlet of the flush valve. Each of the pipes exhibited a radius of curvature that was greater than a threshold value thereof. The pipes included one conventional pipe exhibiting a length of 15 cm and a plurality of noise reduction pipes exhibiting a length of 30 cm or greater. Each of the noise reduction pipes exhibited different lengths ranging from 30 cm to 185 cm. The length for each of the pipes is shown in FIG. 7. Tests were performed using each of the pipes by flushing the vacuum-assisted toilet system to determine the noise generated by flowing waste through each of the pipes.

FIG. 7 is a graph illustrating the noise (in decibels) over time after flushing the vacuum-assisted toilet system of working example 2 using the plurality of different pipes. FIG. 7 illustrates that the conventional pipe exhibited two spikes in the amplitude of the detected noise at about 0.5 seconds and about 4.2 seconds. These spikes in the detected noise were generated by switching the flush valve between the open and closed states thereof. However, FIG. 7 demonstrates that each of the noise reduction pipes eliminated or significantly reduced the spike in the amplitude of the detected noise at about 0.5 seconds and noticeably reduced the amplitude of the detected noise at 4.2 seconds. FIG. 7 also demonstrates that each of the noise reduction pipes reduced the amplitude of the detected noise for most of the time between 0.5 second and 4.2 seconds. As such, FIG. 7 demonstrates that increasing the length of the pipes to be greater than about 30 cm reduces the amplitude of the detected noise.

While various aspects and embodiments have been disclosed herein, other aspects and embodiments are contemplated. The various aspects and embodiment disclosed herein are for purposes of illustration and are not intended to be limiting.

We claim:

1. A vacuum-assisted toilet system comprising:

a toilet bowl defining an outlet;

a base supporting the toilet bowl above a surface;

a flush valve configured to switch between an open state and a closed state, the flush valve including an inlet;

a noise reduction pipe extending between the outlet of the toilet bowl and the inlet of the flush valve, the noise reduction pipe including a first end coupled to the outlet of the toilet bowl and a second end coupled to the inlet of the flush valve, the noise reduction pipe defining a fluid flow path extending from the first end to the second end, the noise reduction pipe including one or more bends between the first end and the second end, each of the one or more bends exhibiting a radius of curvature that is greater than about 5 cm, the one or more bends in the noise reduction pipe cause at least a portion of the noise reduction pipe to at least one of:

loop through the base;

be positioned within a gap between an inner wall and an outer wall of the toilet bowl;

include at least one portion extending between two bends that is generally parallel to the surface; or include a first bend configured to curve the noise reduction pipe from a first side of the base to an adjacent side of the base and a second bend configured to loop the noise reduction pipe about 180° so that, after the second bend, the noise pipe extends in a generally opposing direction than before the second bend, wherein the first bend and the second bend maintain the noise reduction pipe under or substantially under the toilet bowl; and a vacuum source fluidly coupled to and positioned downstream from the flush valve.

2. The vacuum-assisted toilet system of claim 1, wherein the radius of curvature of each of the one or more bends of the noise reduction pipe is greater than about 9 cm.

3. The vacuum-assisted toilet system of claim 1, wherein the noise reduction pipe exhibits a length measured along a center of the fluid flow path that is greater than about 30 cm.

4. The vacuum-assisted toilet system of claim 3, wherein the length of the noise reduction pipe is about 30 cm to about 60 cm.

5. The vacuum-assisted toilet system of claim 3, wherein the flush valve is positioned within 15 cm of the outlet of the toilet bowl.

6. The vacuum-assisted toilet system of claim 1, wherein a length of the noise reduction pipe measured along a center of the fluid flow path is greater than a distance between the outlet of the toilet bowl and the inlet of the flush valve.

7. The vacuum-assisted toilet system of claim 1, wherein the one or more bends in the noise reduction pipe includes a plurality of bends.

8. The vacuum-assisted toilet system of claim 1, wherein the noise reduction pipe further includes one or more sharp bends at or near the second end, wherein the one or more sharp bends exhibit a radius of curvature that is less than 4.5 cm.

9. The vacuum-assisted toilet system of claim 1, wherein the one or more bends in the noise reduction pipe cause the pipe to include at least one of loop around or through a base that supports the toilet bowl above a surface.

10. The vacuum-assisted toilet system of claim 1, wherein the noise reduction pipe is flexible.

11. The vacuum-assisted toilet system of claim 1, wherein the noise reduction pipe is rigid.

12. A vacuum-assisted toilet system comprising:

a toilet bowl defining an outlet;

a flush valve configured to switch between an open state and a closed state, the flush valve including an inlet;

a noise reduction pipe extending between the outlet of the toilet bowl and the inlet of the flush valve, the noise reduction pipe including a first end coupled to the outlet of the toilet bowl and a second end coupled to the inlet of the flush valve, the noise reduction pipe defining a fluid flow path extending from the first end to the second end, the noise reduction pipe including one or more bends between the first end and the second end, the noise reduction pipe exhibiting a length measured along a center of the fluid flow path that is greater than about 30 cm, the one or more bends in the noise reduction pipe cause at least a portion of the noise reduction pipe to at least one of:

loop through a base; or be positioned within a gap between an inner wall and an outer wall of the toilet bowl; and a vacuum source fluidly coupled to and positioned downstream from the flush valve.

13. The vacuum-assisted toilet system of claim 12, wherein the length of the noise reduction pipe is about 30 cm to about 60 cm.

14. The vacuum-assisted toilet system of claim 12, wherein a radius of curvature of each of the one or more bends of the noise reduction pipe is greater than about 9 cm.

* * * * *